United States Patent [19]

Angelo et al.

[11] 4,102,056

[45] Jul. 25, 1978

[54] METHOD AND APPARATUS FOR INTRODUCING A PARTICULATE OR PULVERULENT MATERIAL INTO A FLOW OF GAS

[75] Inventors: Peter Aage Rørby Angelo, Allerød; Ole Klingest, Lyngby; Christian Schwarzbach, Glostrup, all of Denmark

[73] Assignee: Aktieselskabet Niro Atomizer, Soborg, Denmark

[21] Appl. No.: 679,368

[22] Filed: Apr. 22, 1976

[30] Foreign Application Priority Data

Apr. 22, 1975 [DK] Denmark ..... 1726/75

[51] Int. Cl.[2] ..... F26B 3/08

[52] U.S. Cl. ..... 34/10; 34/57 A; 432/14; 432/58

[58] Field of Search ..... 34/10, 57 R, 57 A, 57 D; 432/14, 58; 302/29

[56] References Cited

U.S. PATENT DOCUMENTS

| | | | |
|---|---|---|---|
| 3,133,805 | 5/1964 | Robinson | 432/58 X |
| 3,518,772 | 7/1970 | Barr | 34/10 |
| 3,982,884 | 9/1976 | Godel | 432/14 |
| 3,998,596 | 12/1976 | Fukuda et al. | 34/57 A |
| 4,002,420 | 1/1977 | Christiansen | 432/14 |

*Primary Examiner*—John J. Camby
*Attorney, Agent, or Firm*—Dennison, Dennison, Meserole & Pollack

[57] ABSTRACT

A method and apparatus for introducing a particulate or pulverulent material into a tube or duct in which material is pneumatically transported by a gas flow and possibly simultaneously subjected to some kind of treatment. The material is currently thrown into the duct as a continuous stream or bed, for example by means of a fast moving conveyor belt. Before the stream of material reaches the said duct it is exposed to one or more transversely directed gas jets for spreading the particles in the stream and directing them into the duct through an inlet opening therein.

6 Claims, 2 Drawing Figures

METHOD AND APPARATUS FOR INTRODUCING A PARTICULATE OR PULVERULENT MATERIAL INTO A FLOW OF GAS

BACKGROUND OF THE INVENTION

1. Field of the Invention

The present invention relates to a method and apparatus for introducing a particulate or pulverulent material into a flow of gas confined within a tube or duct for pneumatically transporting said material by said gas flow. The said material may be introduced into the gas flow exclusively in order to have the material transported by that flow. However, normally it is also intended to obtain some kind of treatment of the particulate or pulverulent material during said transport. Thus, for example the material may be flash dried in the transporting gas flow which may consist of hot gas or air, or some other kind of physical or chemical interaction between the material and the gas may take place during the transport of the material.

2. Description of the Prior Art

From Applicants' Danish published patent specification No. 129.602 it is known to flash dry sand or a similar particulate material in a transporting flow of drying gas, the material being thrown into said flow of drying gas by means of a rotor. In order to obtain the best possible surface contact between the particulate material and the drying gas and in order to obtain a good suspension or "airbearing" of the material in the transporting and/or treating gas it is important to obtain a good spreading of the particles in the material before or when these particles are introduced into the transport tube or duct. By using a throw-in rotor or other suitable mechanical throw-in devices it is possible to obtain an acceptable spreading of the particles of the material provided that the stream of the material generated by the throw-in device is relatively small. This condition, however, does not really harmonize with the fact that it is normally desired to have the greatest possible amount of material treated and/or transported in the smallest possible period of time.

SUMMARY OF THE INVENTION

The present invention provides a method of the type described by means of which for a given transporting gas flow it is possible to obtain a satisfactory throwing-in of substantially greater amounts of material per time unit than by using the above known methods.

The present invention provides a method of introducing a particulate or pulverulent material into a flow of gas confined within a tube or duct having an inlet opening so as to transport said material within said duct by said gas flow, said method comprising: currently directing a floating or airborne stream of said material along a substantially rectilinear path towards said duct, and exposing said floating stream of material to at least one transversely directed gas jet outside said duct so as to spread the particles in said stream and direct them into said duct through said inlet opening. The transverse gas jet or jets may be directed substantially perpendicular to the said stream of material directed towards the duct or tube, or form an acute angle with said stream of material. Furthermore, the transverse gas jet or jets may be directed so as to have a component of motion in or opposite to the direction of motion for the transporting gas flow, and in addition to the spreading function the said gas jet or jets may also be used to shape the stream of material directed towards the transporting tube or duct and to keep the stream of material within predetermined limits which may for example correspond to the periphery of the material inlet opening in the transporting tube or duct.

The said material may be thrown into the transporting tube or duct by means of any kind of suitable throwing-in means, for example by a rotor provided with blades. However, according to the invention the material is preferably thrown towards the transporting tube or duct by feeding it to the upper run of a fast moving conveyor belt. Thereby it is possible to throw the material towards the transporting duct as a layer or bed of material having a width corresponding to the width of the conveyor belt, and a thickness which may be controlled so as to obtain the optimum value. By using such a conveyor belt it is possible to obtain a substantial reduction of the problem of wear which is present in connection with a rotor.

The invention also provides an apparatus for pneumatically transporting a particulate or pulverulent material, said apparatus comprising a tube or duct having an inlet opening for said material, means for providing a flow of gas through said tube or duct, material feeding means for providing a floating or airborne stream of said material directed towards said tube or duct along a substantially rectilinear path, and gas jet means arranged outside said tube or duct for directing at least one gas jet transversely to said path so as to spread the particles of the material in said stream and direct the same into said duct through the inlet opening thereof.

BRIEF DESCRIPTION OF THE DRAWING

The invention will now be further explained with reference to the drawings, wherein.

DESCRIPTION OF THE PREFERRED EMBODIMENT

Figure 1:
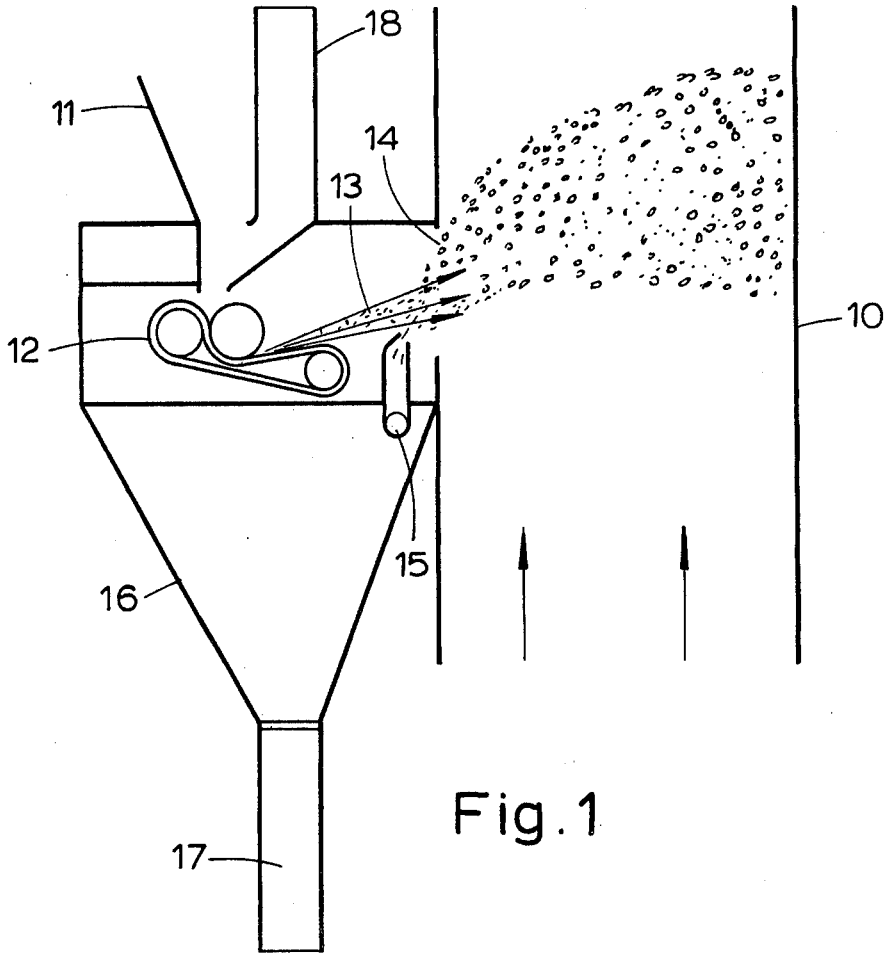
FIG. 1 shows diagrammatically a side view of a flash drying apparatus or system in accordance with the invention.

The drawings show a flash drying apparatus or system having a substantially vertical tube or duct 10 through which a flow of hot drying air or gas is provided in upward direction. A uniform stream of pulverulent or particulate material to be dried is fed through a feeding funnel 11 down onto a fast moving conveyor belt or throwing-in conveyor 12 which is shown in greater detail in FIG. 2. The material falling from the feeding funnel 11 onto the throwing-in conveyor 12 is thrown towards an inlet opening 14 in the duct 10 as a relatively compact, continuous bed or stream 13 of material. Immediately before the stream 13 of material reaches the inlet opening 14 it is exposed to a transverse, obliquely upwardly directed air jet from a blower or nozzle 15 whereby the particles of the material in the floating bed or stream of material 13 are spread before they reach the gas flow within the duct 10 so that a uniform distribution of the material over the cross section of the transporting or flash drying duct is obtained. Consequently a good surface contact between the drying gas in the duct 10 and the particles of material is obtained and the said particles easily become suspended or airborne in the flash drying duct even if a rather heavy stream of material is thrown into the duct.

A collecting funnel 16 is arranged below the throwing-in conveyor 12 for collecting material falling from the conveyor 12 and for returning that material to the feeding funnel 11 through lower and upper return tubes 17 and 18, respectively, and by means of transporting means, such as a bucket conveyor, not shown.

Figure 2:
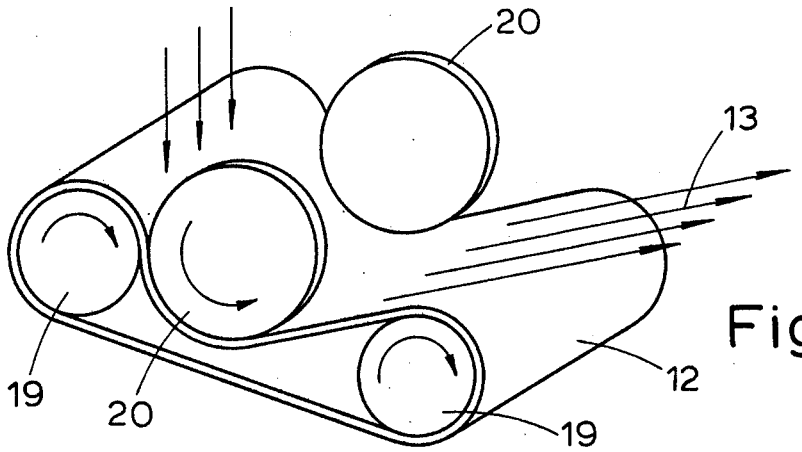
FIG. 2 shows in a larger scale a perspective view of a throwing-in conveyor.

As shown in FIG. 2 the throwing-in conveyor belt 12 is passed around a pair of rollers 19 and engages a pair of discs 20 contacting the upper run of the belt at opposite side edges in such a manner that the said upper run is directed obliquely upwardly downstream of said discs.

EXAMPLE

In an experimental set up a throwing belt of the type shown in FIG. 2 was used for throwing sand having a water content ranging between 10 and 20 percent by weight. The throwing belt worked at a linear velocity of 4.3 meters per second, and an amount of sand of 7,000 - 11,000 kg/hour was thrown in the form of a relatively solid stream forming an angle of approximately 30° with a horizontal plane. A blower with an obliquely upwardly and forwardly directed blowing slot having the dimensions 95 × 70 mm was arranged approximately 35 cm in front of the throwing belt and below the thrown stream of sand. The blower generated an amount of air of 1480 $m^3$/hour, and the air velocity in the blower slot as 62 meters per second.

The air jet generated by the blower spread the sand particles in the solid stream of sand thrown from the throwing belt to such an extent that the spread stream was suited to be directed into a flash drying apparatus or system in spite of the relatively great mass flow.

It should be undersood that various modifications of the embodiment shown in the drawings could be made within the scope of the invention. For example, the flash drying duct 10 need not be arranged vertically, but may alternatively have a slanting or horizontal direction. In the embodiment shown on the drawings the air jet generated by the blower 15 is directed into the duct 10. However, in some cases it may be desirable to avoid an intermixing of the spreading air jet from the blower 15 and the transporting air flow within the duct 10. Even though only one air nozzle is shown in FIG. 1 several air nozzles of that type may be used, if desired, and they need not necessarily be directed upwardly as shown in the drawings. Alternatively, the air nozzles may be directed obliquely downwardly and opposite to the air flow within the duct 10, if desired. Thereby an increased relative velocity between the transporting or drying air or gas within the duct 10 and the particles of material thrown thereinto may be obtained. Finally, it should be mentioned that any other type of throwing-in device, such as a rotor provided with blades could be used instead of the throwing belt 12 shown in the drawings.

We claim:

1. A method of introducing a particulate or pulverulent material into a flow of a first gas confined within a substantially vertical tube or duct having a lateral inlet opening so as to transport said material within said duct by said gas flow, said method comprising:

throwing a freely floating or airborne stream of said material from mechanical conveyor means into said tube or duct inlet opening from a position substantially spaced therefrom, said freely floating stream of material being exposed to at least one generally transversely directed jet of a second gas outside said duct so as to spread the particles of material in said stream and direct them into said duct through said inlet opening.

2. A method according to claim 1, wherein said material is thrown towards said duct inlet opening by feeding it to the upper run of a fast moving conveyor belt.

3. A method of transporting a particulate or pulverulent material within a substantially vertical tube or duct, said method comprising:

(a) throwing a freely floating or airborne stream of said material from mechanical conveyor means into said tube or duct from a position substantially spaced therefrom, said freely floating stream of material being exposed to at least one jet of a first gas directed generally transversely to said stream for spreading the particles of material in said stream and directing the stream into said duct through an inlet opening, and (b) passing a second gas flow through said tube or duct for transporting said particles of material along said tube or duct in a dispersed condition.

4. A method according to claim 3, wherein said material is thrown towards said duct by feeding it to the upper run of a fast moving conveyor belt.

5. An apparatus for pneumatically transporting a particulate or pulverulent material, said apparatus comprising:

(a) a substantially vertical tube or duct having a lateral inlet opening for said material, (b) means for providing a vertical flow of a first gas longitudinally through said tube or duct, (c) mechanical material conveying means spaced from said inlet for throwing a freely floating or airborne stream of said material towards said tube or duct inlet along a substantially rectilinear path, and (d) gas jet means arranged outside said tube or duct for directing at least one jet of a second gas generally transversely to said path between said material conveying means and said inlet so as to spread the particles of the material in said stream and direct the same into said duct through the inlet opening thereof.

6. An apparatus according to claim 5, wherein said material conveying means comprises a conveyor belt, means for driving said belt at a high velocity, and means for feeding material to the upper run of said belt.

* * * * *